US012007195B2

(12) United States Patent
Finandis

(10) Patent No.: US 12,007,195 B2
(45) Date of Patent: Jun. 11, 2024

(54) SELF-DEFENSE WHIP

(71) Applicant: Allen Finandis, Conover, NC (US)

(72) Inventor: Allen Finandis, Conover, NC (US)

( * ) Notice: Subject to any disclaimer, the term of this patent is extended or adjusted under 35 U.S.C. 154(b) by 225 days.

(21) Appl. No.: 17/748,469

(22) Filed: May 19, 2022

(65) Prior Publication Data

US 2023/0375305 A1 Nov. 23, 2023

(51) Int. Cl.
*F41B 15/02* (2006.01)

(52) U.S. Cl.
CPC ..... *F41B 15/02* (2013.01)

(58) Field of Classification Search
CPC ..... F41B 15/02
USPC ..... 463/47.2
See application file for complete search history.

(56) References Cited

U.S. PATENT DOCUMENTS 3,246,894 A * 4/1966 Salisbury ..... A63B 60/10 482/109
3,690,655 A * 9/1972 Chapman ..... A63B 23/14 482/109
3,946,518 A * 3/1976 Ylitalo ..... A63F 7/382 273/109
3,991,510 A * 11/1976 Bytheway ..... A63B 21/0624 482/148
4,135,719 A 1/1979 Braunhut
4,456,255 A 6/1984 Braunhut
4,687,131 A 8/1987 Braunhut
4,702,474 A * 10/1987 Guibert ..... A63B 21/072 482/44
4,809,975 A * 3/1989 Lee ..... A63B 69/36 482/109
4,819,935 A * 4/1989 Dirksing ..... A63B 69/38 482/109
5,281,192 A * 1/1994 Nelson ..... A63B 21/4035 482/109
5,312,308 A * 5/1994 Hamilton ..... A63B 21/072 482/44
5,360,209 A * 11/1994 Mollica ..... A63B 24/0062 473/457
5,577,966 A * 11/1996 Duran ..... A63B 69/3635 473/235
5,711,718 A * 1/1998 Mueller ..... A63B 60/04 473/234
5,769,734 A * 6/1998 Qualey, Sr. ..... A63B 60/04 482/109
6,089,449 A 7/2000 Butterworth
6,461,163 B1 * 10/2002 Gallagher ..... A63B 60/04 434/252
6,955,610 B1 * 10/2005 Czaja ..... A63B 60/04 473/226

(Continued)

*Primary Examiner* — Michael C Grant

(57) ABSTRACT

A self-defense whip for protecting against would-be attackers and serving as an alternative to other available means of self-defense includes a handle having a first end and a second end. A flexible cord has a proximate end relative to the handle and a distal end relative to the handle, the proximate end of the flexible cord being coupled to the second end of the handle. Each of a plurality of annular weights receives therethrough the flexible cord proximate the distal end of the flexible cord. A catch is coupled to the distal end of the cable and has a width greater than an inner diameter of each annular weight wherein the catch is configured to prevent each annular weight from moving past the distal end of the flexible cord.

14 Claims, 5 Drawing Sheets

(56) References Cited

U.S. PATENT DOCUMENTS

| | | | | |
|---|---|---|---|---|
| 7,175,575 | B1 * | 2/2007 | Dantolen | A63B 21/05 482/121 |
| 7,557,286 | B2 * | 7/2009 | Capotosto | A63B 21/0004 84/422.4 |
| 7,618,328 | B2 * | 11/2009 | Davenport | A63B 69/3623 473/219 |
| 7,798,910 | B2 * | 9/2010 | Leadbetter | A63B 69/3614 473/215 |
| 7,993,219 | B2 * | 8/2011 | Whitney | A63B 69/0002 473/457 |
| 8,444,502 | B2 * | 5/2013 | Karube | A63B 53/007 473/297 |
| 8,491,422 | B2 * | 7/2013 | Deschesnes | A63B 21/055 473/422 |
| 8,821,323 | B2 * | 9/2014 | Liu | A63B 59/50 473/422 |
| 9,480,876 | B1 * | 11/2016 | Blacklock | A63B 21/00072 |
| 9,604,113 | B2 * | 3/2017 | Fierro | A63B 15/005 |
| 9,687,718 | B1 * | 6/2017 | Sorenson | A63B 69/0091 |
| 10,441,860 | B1 * | 10/2019 | Chung | A63B 60/24 |
| 2003/0121946 | A1 | 7/2003 | Tai | |
| 2007/0123399 | A1 * | 5/2007 | Kim | A63B 15/005 482/109 |
| 2010/0248867 | A1 * | 9/2010 | Tande | A63B 15/005 473/457 |
| 2021/0108882 | A1 * | 4/2021 | Duford | F41B 15/02 |
| 2022/0193523 | A1 * | 6/2022 | Schaefer | A63B 21/4035 |

* cited by examiner

SELF-DEFENSE WHIP

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to self-defense weapons and more particularly pertain to a new self-defense whip, which is a lightweight, portable, concealable weapon for protecting against would-be attackers and serves as an alternative to other available means of self-defense.

BRIEF SUMMARY OF THE INVENTION

An embodiment of the disclosure meets the needs presented above by generally comprising a handle having a first end and a second end. A flexible cord has a proximate end relative to the handle and a distal end relative to the handle, the proximate end of the flexible cord being coupled to the second end of the handle. Each of a plurality of annular weights receives therethrough the flexible cord proximate the distal end of the flexible cord. A catch is coupled to the distal end of the cable and has a width greater than an inner diameter of each annular weight wherein the catch is configured to prevent each annular weight from moving past the distal end of the flexible cord.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
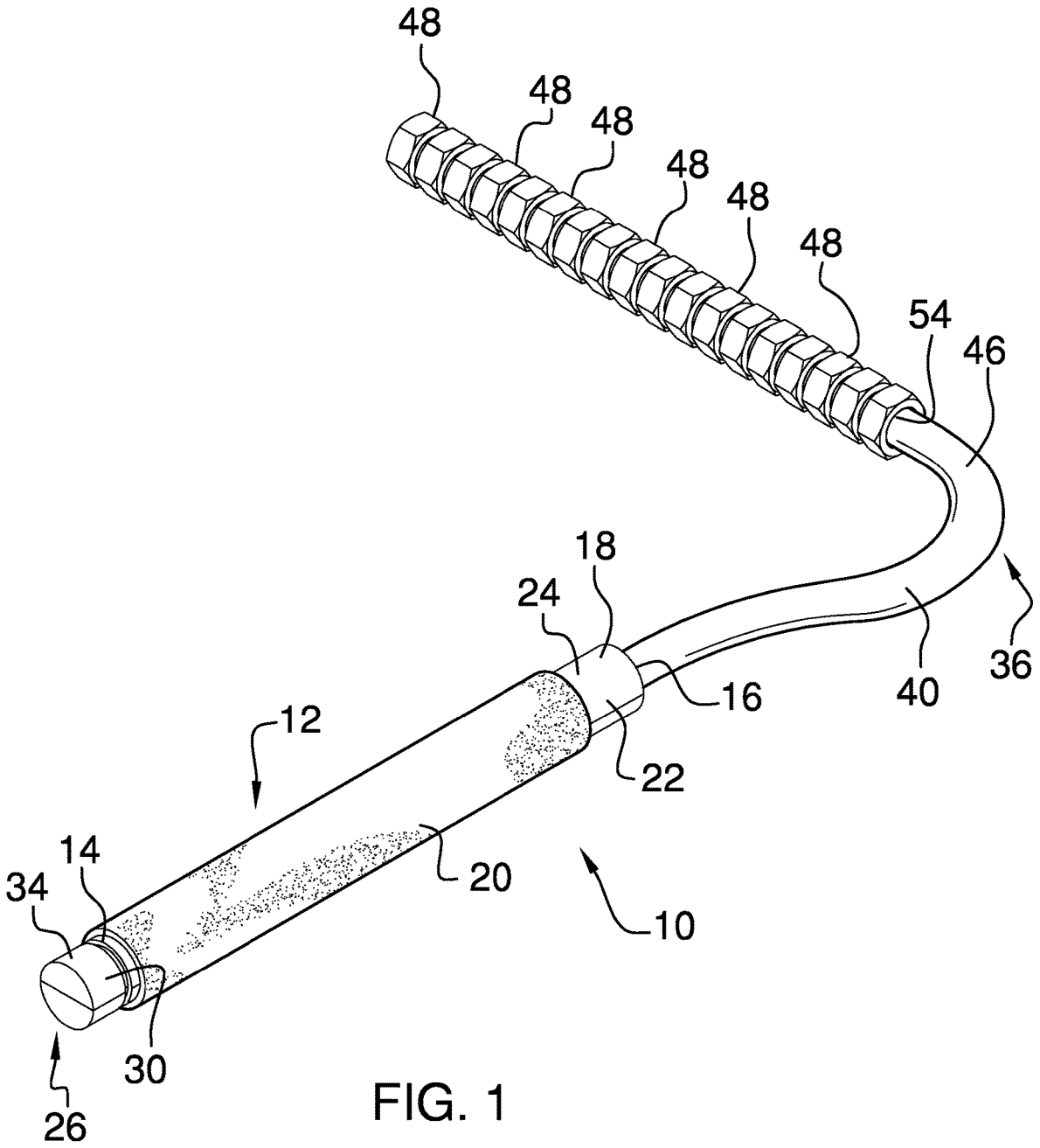
FIG. 1 is a front top side perspective view of a self-defense whip according to an embodiment of the disclosure.
Figure 2:
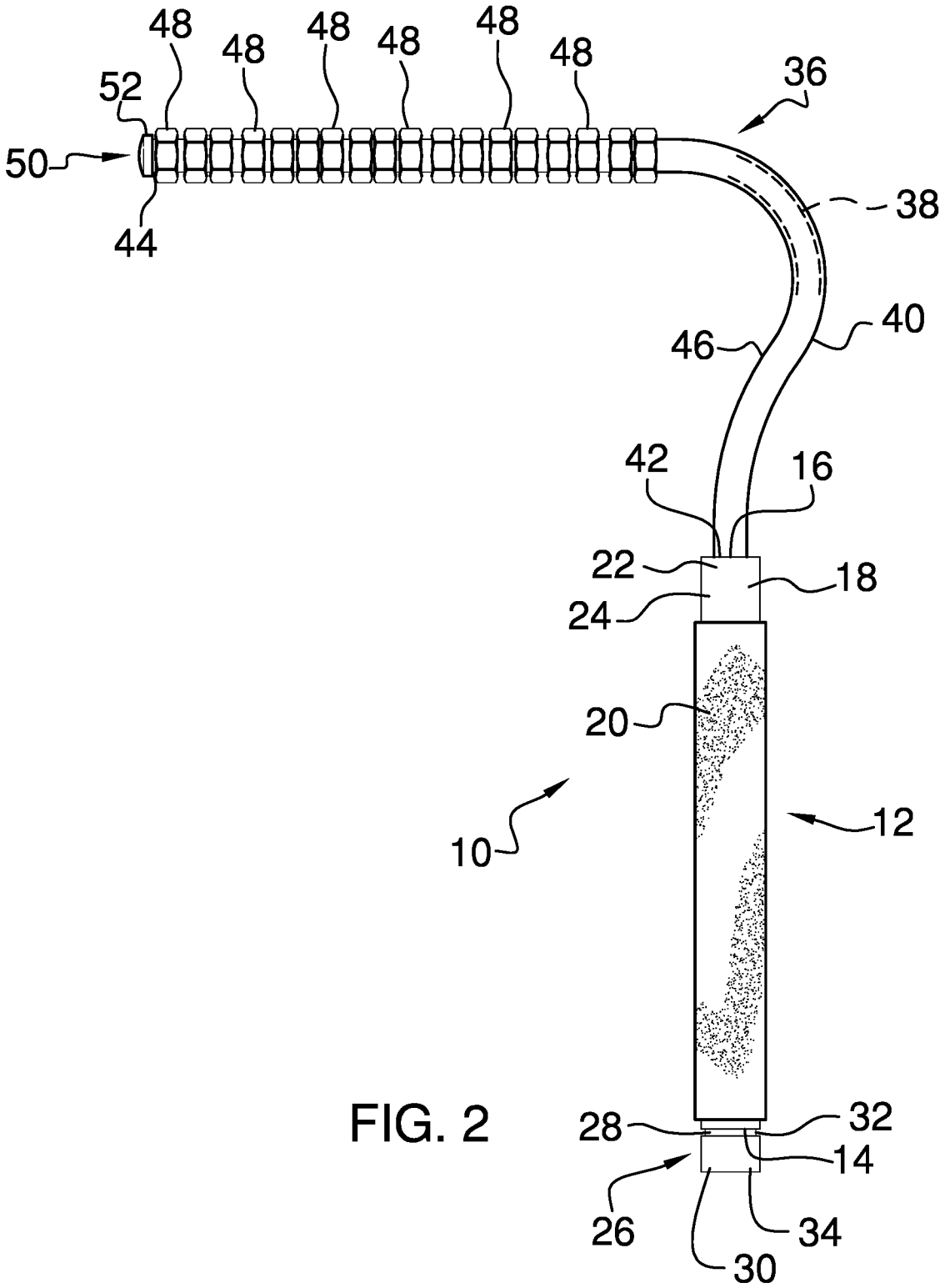
FIG. 2 is a front view of an embodiment of the disclosure.
Figure 3:
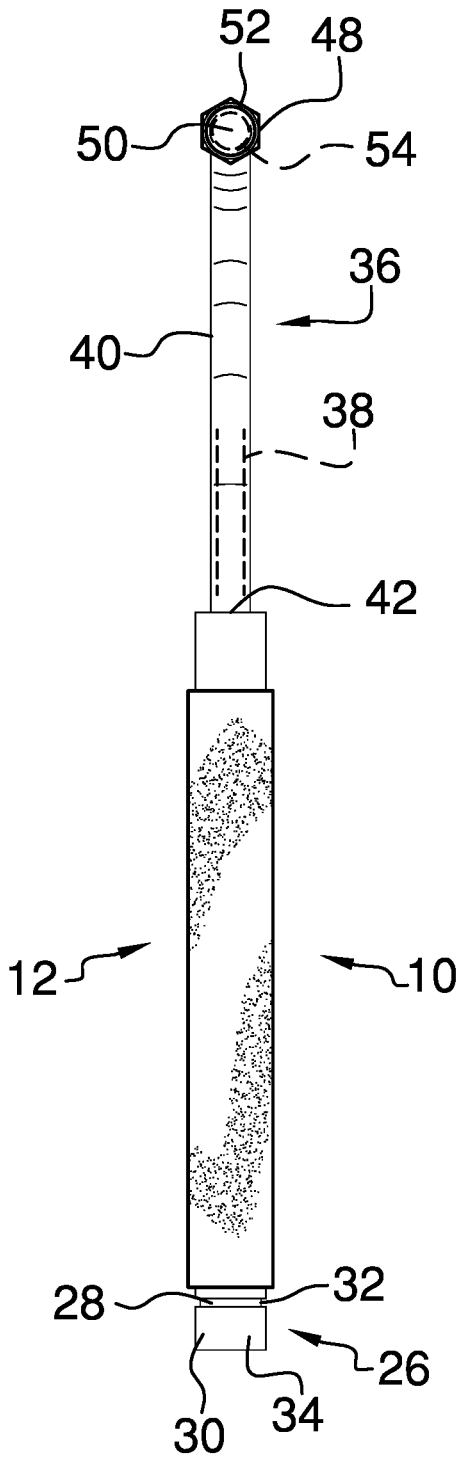
FIG. 3 is a side view of an embodiment of the disclosure.
Figure 4:
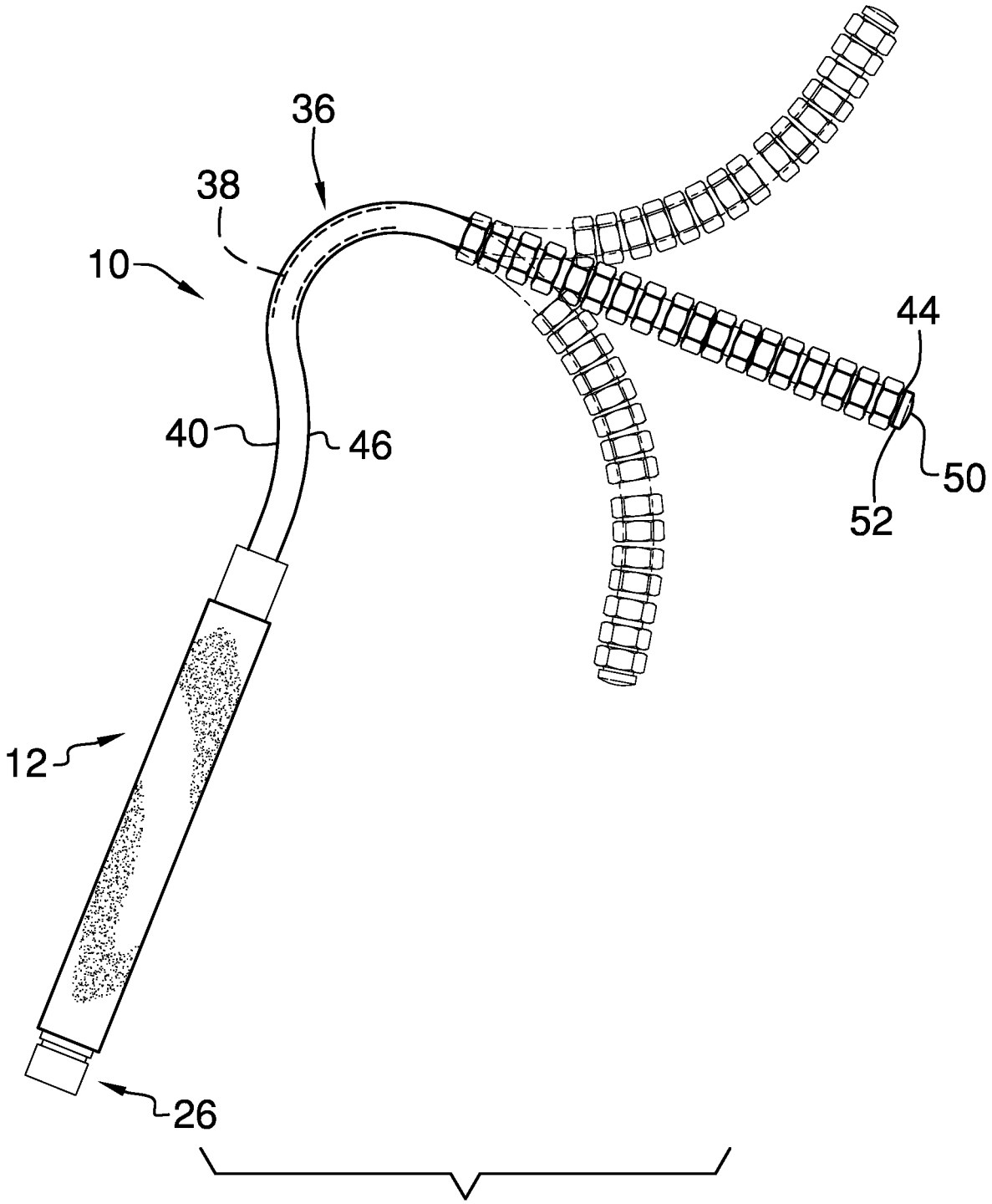
FIG. 4 is a back in-use view of an embodiment of the disclosure.
Figure 5:
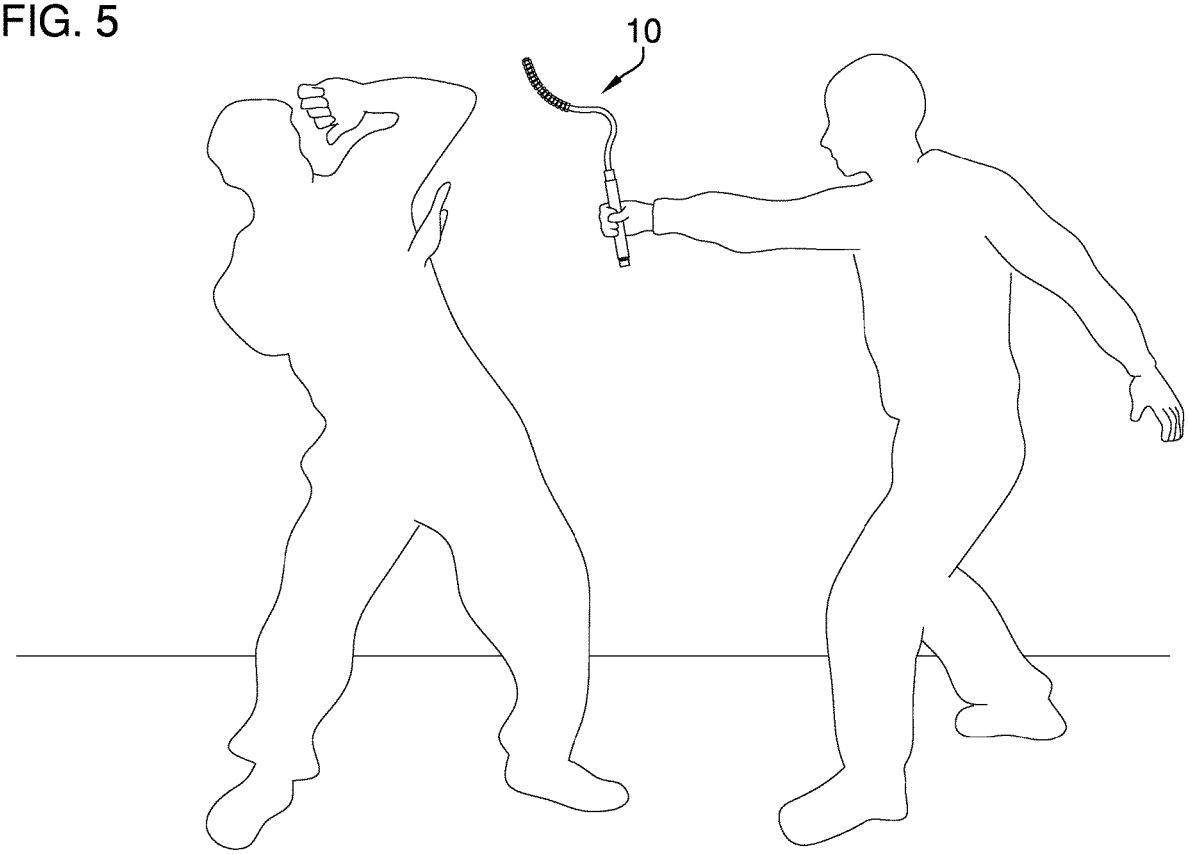
FIG. 5 is an in-use view of an embodiment of the disclosure.

With reference now to the drawings, and in particular to FIGS. 1 through 5 thereof, a new self-defense weapon embodying the principles and concepts of an embodiment of the disclosure and generally designated by the reference numeral 10 will be described.

As best illustrated in FIGS. 1 through 6, the self-defense whip 10 generally comprises a handle 12 having a first end 14 and a second end 16 wherein the handle 12 includes a hollow inner tube 18 and a grip 20. The inner tube 18 extends from the first end 14 to the second end 16, has a length of 34.29 centimeters, and has an outer diameter 22 of between 2.54 and 3.81 centimeters. However, the inner tube 18 may have a different length and a different outer diameter 22. The inner tube 18 is constructed of metal but may be constructed of another conventional material. The grip 20 has an inner surface adjacent to an outer surface 24 of the inner tube 18 and extends less than the length of the inner tube 18 from the first end 14 toward the second end 16. The grip 20 is constructed of rubber but may be constructed of another conventional material.

A cap 26 has a penetrating section 28 and a protruding section 30 wherein the penetrating section 28 extends into the inner tube 18 at the first end 14 of the handle 12 and the protruding section 30 extends away from the first end 14 of the handle 12. The penetrating section 28 has a cylindrical surface 32 adjacent to an inner surface of the inner tube 18, while the protruding section 30 has a diameter 34 equal to the outer diameter 22 of the inner tube 18.

A flexible cord 36 includes a cable 38 and a sleeve 40 and has a proximate end 42 relative to the handle 12 and a distal end 44 relative to the handle 12. The proximate end 42 of the flexible cord 36 is coupled to the second end 16 of the handle 12. The flexible cord 36 has a length of 33.87 centimeters but may have a different length. The cable 38 extends along the flexible cord 36 and is constructed of metal but may be constructed of another conventional material. The sleeve 40 extends along the cable 38 and has an inner surface adjacent to an outer surface 24 of the cable 38. The sleeve 40 has an outer diameter 46 less than the outer diameter 22 of the inner tube 18. The sleeve 40 is constructed of rubber but may be constructed of another conventional material.

Each of a set of 18 hexagonal nuts 48 receives therethrough the flexible cord 36 proximate the distal end 44 of the cable 38. A hexagonal nut 48 is just one example of an annular weight suitable for the apparatus, and there may be a different number of weights. A catch 50 is coupled to the distal end 44 of the cable 38 and has a width 52 greater than an inner diameter 54 of each hexagonal nut 48 wherein the catch 50 is configured to prevent each hexagonal nut 48 from moving past the distal end 44 of the flexible cord 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A self-defense whip comprising:

a handle having a first end and a second end;

a flexible cord having a proximate end relative to said handle and a distal end relative to said handle, said proximate end of said flexible cord being coupled to said second end of said handle;

a plurality of annular weights, each said annular weight receiving therethrough said flexible cord proximate said distal end of said flexible cord; and a catch coupled to said distal end of said cable, said catch having a width greater than an inner diameter of each said annular weight wherein said catch is configured to prevent each said annular weight from moving past said distal end of said flexible cord.

2. The apparatus of claim 1, wherein said handle includes a hollow inner tube and a grip, said inner tube extending from said first end to said second end, said grip having an inner surface adjacent to an outer surface of said inner tube.

3. The apparatus of claim 2, wherein said inner tube has a length of 34.29 centimeters, said inner tube having an outer diameter of between 2.54 and 3.81 centimeters.

4. The apparatus of claim 2, wherein said grip extends less than said length of said inner tube from said first end toward said second end.

5. The apparatus of claim 2, wherein said inner tube is constructed of metal.

6. The apparatus of claim 2, wherein said grip is constructed of rubber.

7. The apparatus of claim 2, further comprising:

a cap having a penetrating section and a protruding section, said penetrating section extending into said inner tube at said first end of said handle, said penetrating section having a cylindrical surface adjacent to an inner surface of said inner tube, said protruding section extending away from said first end of said handle, said protruding section having a diameter equal to said outer diameter of said inner tube.

8. The apparatus of claim 1, wherein said flexible cord has a cable and a sleeve, said cable extending along said flexible cord, said sleeve extending along said cable and having an inner surface adjacent to an outer surface of said cable, said sleeve having an outer diameter less than said outer diameter of said inner tube.

9. The apparatus of claim 8, wherein said flexible cord has a length of 33.87 centimeters.

10. The apparatus of claim 8, wherein said cable is constructed of metal.

11. The apparatus of claim 8, wherein said sleeve is constructed of rubber.

12. The apparatus of claim 1, wherein said plurality of annular weights is a plurality of hexagonal nuts.

13. The apparatus of claim 1, wherein said plurality of annular weights is a set of 18 annular weights.

14. A self-defense whip comprising:

a handle having a first end and a second end, said handle including a hollow inner tube and a grip, said inner tube extending from said first end to said second end, said inner tube having a length of 34.29 centimeters, said inner tube having an outer diameter of between 2.54 and 3.81 centimeters, said inner tube being constructed of metal, said grip having an inner surface adjacent to an outer surface of said inner tube, said grip extending less than said length of said inner tube from said first end toward said second end, said grip being constructed of rubber;

a cap having a penetrating section and a protruding section, said penetrating section extending into said inner tube at said first end of said handle, said penetrating section having a cylindrical surface adjacent to an inner surface of said inner tube, said protruding section extending away from said first end of said handle, said protruding section having a diameter equal to said outer diameter of said inner tube;

a flexible cord including a cable and a sleeve, said flexible cord having a proximate end relative to said handle and a distal end relative to said handle, said proximate end of said flexible cord being coupled to said second end of said handle, said flexible cord having a length of 33.87 centimeters, said cable extending along said flexible cord, said cable being constructed of metal, said sleeve extending along said cable and having an inner surface adjacent to an outer surface of said cable, said sleeve having an outer diameter less than said outer diameter of said inner tube, said sleeve being constructed of rubber;

a set of 18 hexagonal nuts, each said hexagonal nut receiving therethrough said flexible cord proximate said distal end of said cable; and a catch coupled to said distal end of said cable, said catch having a width greater than an inner diameter of each said hexagonal nut wherein said catch is configured to prevent each said hexagonal nut from moving past said distal end of said flexible cord.

* * * * *